US010857810B2

(12) United States Patent
Mor et al.

(10) Patent No.: US 10,857,810 B2
(45) **Date of Patent: *Dec. 8, 2020**

(54) ELECTROSTATIC PRINTING

(71) Applicant: HP Indigo B.V., Amstelveen (NL)

(72) Inventors: Ilanit Mor, Nes Ziona (IL); Yaacov Almog, Nes Ziona (IL); Albert Teishev, Nes Ziona (IL); Tony Azzam, Nes Ziona (IL); Julia Kornilov, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 31 days.

This patent is subject to a terminal disclaimer.

(21) Appl. No.: 16/013,215

(22) Filed: Jun. 20, 2018

(65) Prior Publication Data

US 2018/0361758 A1 Dec. 20, 2018

Related U.S. Application Data

(63) Continuation of application No. 14/893,428, filed as application No. PCT/EP2013/060668 on May 23, 2013, now Pat. No. 10,040,297.

(51) Int. Cl.

| | |
|---|---|
| ***B41J 2/41*** | (2006.01) |
| ***G03G 8/00*** | (2006.01) |
| ***G03G 11/00*** | (2006.01) |

(52) U.S. Cl.

CPC ..... *B41J 2/41* (2013.01); *G03G 8/00* (2013.01); *G03G 11/00* (2013.01)

(58) Field of Classification Search

CPC ..... B41J 2/41

See application file for complete search history.

(56) References Cited

U.S. PATENT DOCUMENTS 5,547,804 A * 8/1996 Nishizawa ..... C09D 11/106 430/114
5,923,929 A 7/1999 Ben Avraham et al.
6,025,300 A * 2/2000 Muto ..... B32B 27/08 503/227
6,835,515 B2 12/2004 Tong et al.

(Continued)

FOREIGN PATENT DOCUMENTS

EP 1341048 9/2003
EP 2138900 12/2009

(Continued)

OTHER PUBLICATIONS

Taber Shear/Scratch Tester (Scratch & Mar), http://www.taberindustries.com/action/print/100032, issued Mar. 21, 2013.

(Continued)

*Primary Examiner* — Alex A Rolland

(74) *Attorney, Agent, or Firm* — Thorpe North & Western LLP

(57) ABSTRACT

Herein is disclosed a method of printing comprising the steps of applying an ink comprising a thermoplastic resin to a print substrate using an electrostatic printing process; and applying an overcoat composition comprising a crosslinking agent to the ink after applying the ink to the print substrate, such that the thermoplastic resin of the ink becomes crosslinked on the print substrate due to interaction with the crosslinking agent.

9 Claims, 5 Drawing Sheets

(56) References Cited

U.S. PATENT DOCUMENTS

| | | | | |
|---|---|---|---|---|
| 7,029,814 | B2 | 4/2006 | Baker et al. | |
| 7,824,830 | B2 | 11/2010 | Kondo et al. | |
| 8,101,327 | B2 | 1/2012 | Tong et al. | |
| 2002/0058190 | A1* | 5/2002 | Ishiyama | G03G 9/0804 430/108.1 |
| 2009/0043081 | A1* | 2/2009 | Arai | C09B 29/0037 534/617 |
| 2009/0061171 | A1 | 3/2009 | Stein et al. | |
| 2009/0226831 | A1 | 9/2009 | Kakino | |
| 2009/0317559 | A1 | 12/2009 | Belelie et al. | |
| 2012/0092427 | A1 | 4/2012 | Ganapathiappan et al. | |

FOREIGN PATENT DOCUMENTS

| | | |
|---|---|---|
| WO | 2007130069 | 11/2007 |
| WO | 2012105952 | 8/2012 |
| WO | 2012130303 | 10/2012 |

OTHER PUBLICATIONS

International Search Report and Written Opinion dated Feb. 7, 2014 for PCT/EP2013/060668, Applicant Hewlett-Packard Indigo B.V.

* cited by examiner

ELECTROSTATIC PRINTING

The present application is a continuation application of U.S. patent application Ser. No. 14/893,428, filed on Nov. 23, 2015, which is a U.S. National Stage Application under 35 U.S.C. 371 of PCT/EP2013/060668, filed on May 23, 2013, each of which is incorporated herein by reference it its entirety.

BACKGROUND

Electrostatic printing processes typically involve creating an image on a photoconductive surface, applying an ink having charged particles to the photoconductive surface, such that they selectively bind to the image, and then transferring the charged particles in the form of the image to a print substrate.

The photoconductive surface is typically on a cylinder and is often termed a photo imaging plate (PIP). The photoconductive surface is selectively charged with a latent electrostatic image having image and background areas with different potentials. For example, an electrostatic ink composition comprising charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate.

DETAILED DESCRIPTION

Figure 1:
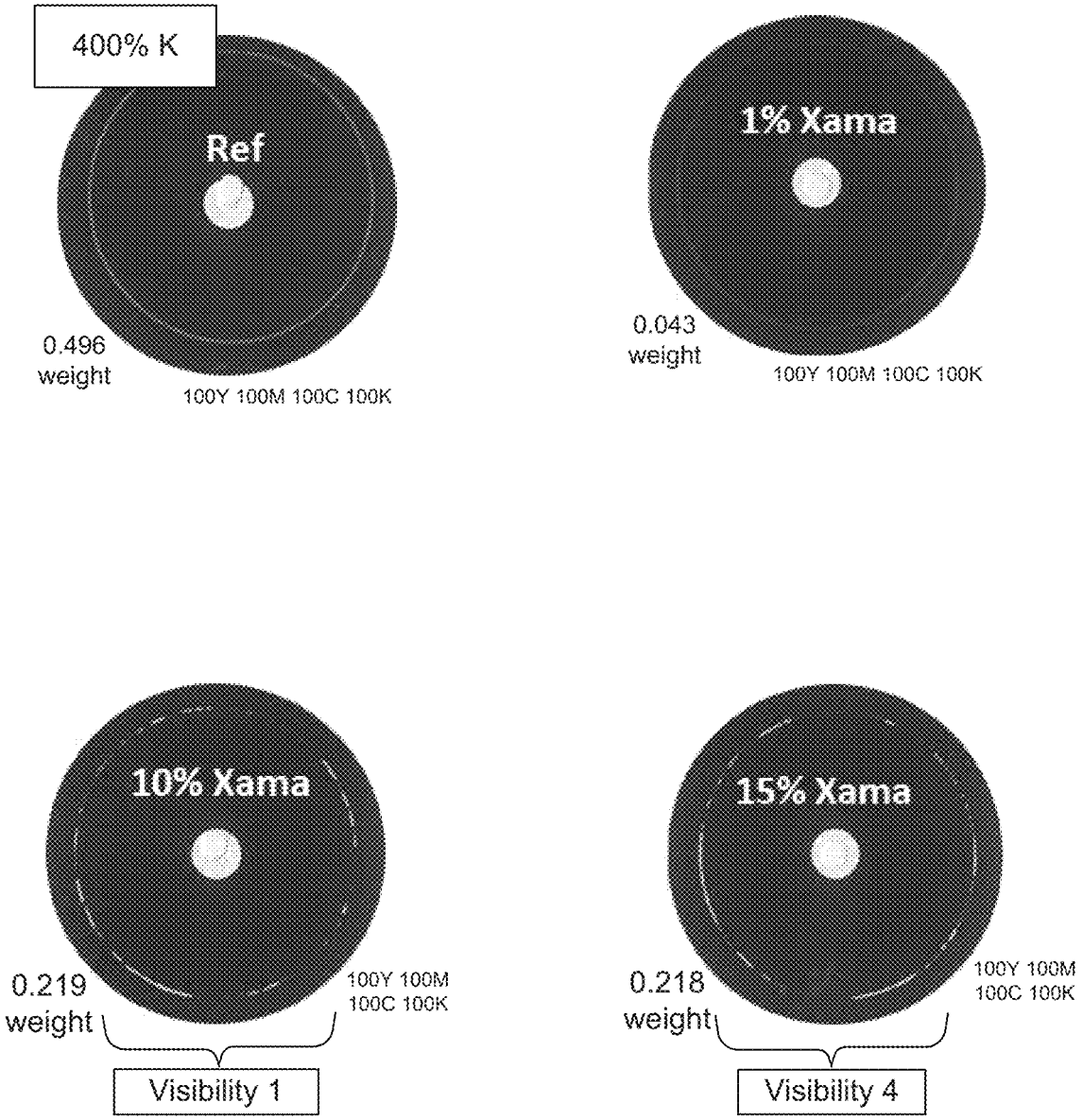
FIG. 1 shows scratch resistance test results for a reference print substrate; and print substrates produced in accordance with embodiments of the method described herein, in this case using a 'Xama2' crosslinking agent. The method of production of these print substrates is described in more detail in the Examples herein.

Before the present disclosure is disclosed and described, it is to be understood that this disclosure is not limited to the particular process steps and materials disclosed herein because such process steps and materials may vary somewhat. It is also to be understood that the terminology used herein is used for the purpose of describing particular embodiments. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "carrier liquid," "carrier," or "carrier vehicle" refers to the fluid in which the polymers, particles, colorant, charge directors and other additives can be dispersed to form a liquid electrostatic ink or electrophotographic ink. The carrier liquids may include a mixture of a variety of different agents, such as surfactants, co-solvents, viscosity modifiers, and/or other possible ingredients.

As used herein, "electrostatic ink composition" generally refers to a ink composition, which may be in liquid or powder form, that is typically suitable for use in an electrostatic printing process, sometimes termed an electrophotographic printing process. The electrostatic ink composition may comprise chargeable particles of a resin, which may be as described herein, dispersed in a carrier liquid, which may be as described herein.

As used herein, "pigment" generally includes pigment colorants, magnetic particles, aluminas, silicas, and/or other ceramics or organo-metallics, whether or not such particulates impart color. Thus, though the present description exemplifies, in some examples, the use of pigment colorants, the term "pigment" can be used more generally to describe not just pigment colorants, but other pigments such as organometallics, ferrites, ceramics, etc.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer, as known in the art. If a melt flow rate of a particular polymer is specified, unless otherwise stated, it is the melt flow rate for that polymer alone, in the absence of any of the other components of the electrostatic ink composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic ink composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrostatic ink composition to an electric field, e.g. an electric field having a field gradient of 50-400V/μm, or more, ins some examples 600-900V/μm, or more.

As used herein, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, "heteroatom" may refer to nitrogen, oxygen, halogens, phosphorus, or sulfur.

As used herein, "alkyl", or similar expressions such as "alk" in alkaryl, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described herein may contain, but are not limited to, from 5 to about 50 carbon atoms, or 5 to about 40 carbon atoms, or 5 to 30 carbon atoms or more, and may be selected from, phenyl and naphthyl.

As used herein, the term "about" is used to provide flexibility to a numerical range endpoint by providing that a given value may be a little above or a little below the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

In an aspect, there is provided a method of printing. The method may comprise the steps of:

(a) applying an ink comprising a thermoplastic resin to a print substrate using an electrostatic printing process; and (b) applying an overcoat composition comprising a crosslinking agent to the ink on the print substrate, such that the thermoplastic resin of the ink is crosslinked.

In an aspect, there is provided a print substrate having printed thereon an ink comprising a thermoplastic resin comprising a polymer selected from ethylene or propylene acrylic acid co-polymers and ethylene or propylene methacrylic acid co-polymers, and having applied onto the ink a crosslinking agent, such that the thermoplastic resin of the ink is crosslinked.

In an aspect, there is provided an electrostatic printing system comprising:

an electrostatic printer having loaded therein an electrostatic ink comprising a thermoplastic resin;

an overcoating device having loaded therein an overcoat composition comprising a crosslinking agent, wherein the system is configured to:

(a) apply the ink comprising a thermoplastic resin to a print substrate using an electrostatic printing process; and (b) apply an overcoat composition comprising a crosslinking agent to the ink on the print substrate, such that the thermoplastic resin of the ink is crosslinked.

The present inventors have found that applying a crosslinking agent to an electrostatic ink composition after printing can increase its durability, such as its scratch resistance. The inventors sought to develop a method that was compatible with an electrostatic printing process and did not result in adverse printing results, such as a negative effect on the printing apparatus and print quality of the inks, such as their colour. The present inventors have found that they can improve the scratch resistance of a printed ink using a very thin layer of overcoat composition, which in some cases results in a final print substrate in which the overcoat composition has a thickness of less than a micron. Compared to some other (non-crosslinking) varnishes, a much thinner layer of overcoat composition described herein is able to achieve the same level of scratch resistance. Additionally, by applying the overcoat composition and effecting the crosslinking after printing, there is minimal effect on the print quality and the print apparatus, compared to if a crosslinker were to be incorporated into an ink before printing.

In some examples, the crosslinking agent is or comprises a polyazridine or a polyepoxide.

In some example, the crosslinking agent has a molecular weight of more than 5000 Daltons. In some examples, the crosslinking agent has a molecular weight of 5000 Daltons or less, in some examples 4000 Daltons or less, in some examples, 3000 Daltons or less, in some examples 1500

Daltons or less, in some examples a molecular weight of 1000 Daltons or less, in some examples a molecular weight of 700 Daltons or less, in some examples a molecular weight of 600 Daltons or less. In some examples, the crosslinking agent has a molecular weight of from 100 to 1500 Daltons, in some examples, in some examples a molecular weight of from 100 to 600 Daltons.

The crosslinking agent may be of the formula (I), $$(X)—(Y—[Z—F]_m)_n \quad \text{formula (I)}$$

wherein, in each $(Y—[Z—F]_m)_n$, Y, Z and F are each independently selected, such that F is selected from an aziridine group, e.g. of the formula $—N(CH_2CR^1H)$, and an epoxide, e.g. group of the formula $—CH(O)CR^2H$, wherein $R^1$ and $R^2$ are selected from H and alkyl;

Z is alkylene,

Y is selected from (i) a single bond, —O—, —C(═O)—O—, —O—C(═O)— and m is 1 or (ii) Y is $—NH_{2-m}$, wherein m is 1 or 2, n is at least 1, in some examples at least 2, in some examples at least 3, in some examples 1 to 4, in some examples 2 to 4, and X is an organic group.

In some examples, the crosslinking agent of formula (I) has at least two F groups, in some examples at least three F groups, in some examples at least four F groups.

X may comprise or be an organic group selected from optionally substituted alkyl, optionally substituted aryl, optionally substituted arylalkyl, optionally substituted alkylaryl, isocyanurate, and a polysiloxane. X may comprise one or more polymeric components; in some examples the polymeric components may be selected from a polysiloxane (such as poly(dimethyl siloxane), a polyalkylene (such as polyethylene or polypropylene), an acrylate (such as methyl acrylate) and a poly(alkylene glycol) (such as poly(ethylene glycol) and poly(propylene glycol)), and combinations thereof. In some examples X comprises a polymeric backbone, comprising a plurality of repeating units, each of which is covalently bonded to $(Y—[Z—F]_m)$, with Y, Z, F and m as described herein. X may be selected from a group selected from trimethyl propane, a branched or straight-chain $C_{1-5}$ alkyl, phenyl, methylene bisphenyl, trisphenylmethane, cyclohexane, isocyanurate.

In some examples, X is selected from (i) an alkane, which may be an optionally substituted straight chain, branched or cyclo-alkane, (ii) a cyclo alkane having at least two substitutents that are $Y—[Z—F]_m$ and (iii) an aryl (such as phenyl). In some examples, X is a selected from (i) a branched alkane, with at least at least two of the alkyl branches covalently bonded to $(Y—[Z—F]_m)$ and (ii) a cyclo alkane having at least two substitutents that are $Y—[Z—F]_m$ and (iii) an aryl (such as phenyl) having at least two substituents that are $Y—[Z—F]_m$; Y is selected from (i) —O—, —C(═O)—O—, —O—C(═O)— and m is 1 or (ii) Y is $—NH_{2-m}$, wherein m is 1 or 2; Z is $C_{1-4}$ alkylene; F is selected from an aziridine group of the formula $—N(CH_2CR^1H)$ and an epoxide of the formula $—CH(O)CR^2H$, wherein $R^1$ and $R^2$ are selected from H and methyl, and in some examples F is $—N(CH_2CR^1H)$ in which $R^1$ is methyl or F is an epoxide of the formula $—CH(O)CR^2H$ in which $R^2$ is H.

In some examples, X is trimethyl propane, in which three methyl groups are each substituted with a $(Y—[Z—F]_m)$ group (i.e. n is 3), in which Y is selected from —O—, —C(═O)—O—, —O—C(═O)— and m is 1, Z is Z is $C_{1-4}$ alkylene, in some examples methylene $(—CH_2—)$ or ethylene $(—CH_2—CH_2—)$; F is selected from an aziridine group of the formula $—N(CH_2CR^1H)$ and an epoxide of the formula $—CH(O)CR^2H$, wherein $R^1$ and $R^2$ are selected from H and methyl, and in some examples F is $—N(CH_2CR^1H)$ in which $R^1$ is methyl or F is an epoxide of the formula $—CH(O)CR^2H$ in which $R^2$ is H.

In some examples, X is phenyl having at least two substituents that are $(Y—[Z—F]_m)$ groups, in which each Y is independently selected from (i) —O—, —C(═O)—O—, —O—C(═O)— and m is 1 or (ii) Y is $—NH_{2-m}$, wherein m is 1 or 2; Z is $C_{1-4}$ alkylene, in some examples methylene or ethylene; F is selected from an aziridine group of the formula $—N(CH_2CR^1H)$ and an epoxide of the formula $—CH(O)CR^2H$, wherein $R^1$ and $R^2$ are selected from H and methyl, and in some examples F is $—N(CH_2CR^1H)$ in which $R^1$ is methyl or F is an epoxide of the formula $—CH(O)CR^2H$ in which $R^2$ is H.

In some examples, Z—F is an epoxycycloalkyl group. In some examples, Z—F is an epoxycyclohexyl group. In some examples, the crosslinking agent comprises two or more epoxycycloalkyl groups, in some examples two or more epoxycyclohexyl groups. In some examples, the crosslinking agent comprises two or more two or more epoxycycloalkyl groups, which are bonded to one another via a linker species; and the linker species may be selected from a single bond, optionally substituted alkyl, optionally substituted aryl, optionally substituted arylalkyl, optionally substituted alkylaryl, isocyanurate, a polysiloxane, —O—, —C(═O)—O—, —O—C(═O)—, and amino and combinations thereof. In some examples, in formula (I) Y is a single bond, X is an organic group of the formula $—X^1-Q-X^2—$, wherein $X^1$, $X^2$ are each independently selected from a single bond and alkyl, and Q is selected from alkyl, —O—, —C(═O)—O—, —O—C(═O)—, and amino; n is 2; m is 1 and Z—F is an epoxycycloalkyl group, in some examples Z—F is an epoxycyclohexyl group. In some examples, in formula (I) Y is a single bond, X is an organic group of the formula $—X^1-Q-X^2—$, wherein $X^1$, $X^2$ are each independently selected from a single bond and $C_{1-4}$ alkyl, and Q is selected from $C_{1-4}$ alkyl, —O—, —C(═O)—O—, —O—C(═O)—; n is 2; m is 1 and Z—F is an epoxycyclohexyl group, optionally a 3,4 epoxycyclohexylgroup. In some examples, Y is a single bond, X is an organic group of the formula $—X^1-Q-X^2—$, wherein one of $X^1$ and $X^2$ is a single bond and the other of $X^1$ and $X^2$ is $C_{1-4}$ alkyl, and Q is selected —O—, —C(═O)—O—, —O—C(═O)—; n is 2; m is 1 and Z—F is an epoxycyclohexyl group, optionally a 3,4 epoxycyclohexylgroup.

In some examples, the crosslinking agent is selected from trimethylpropane tris(2-methyl-1-azridinepropionate), 1,2,7,8-diepoxy octane, trimethylolpropane triglycidyl ether, resorcinol diglycidyl ether, N,N-Diglycidyl-4-glycidyloxyaniline, 4,4'-Methylenebis(N, N-diglycidylaniline), tris(4-hydroxyphenyl)methane triglycidyl ether, diglycidyl 1,2-cyclohexanedicarboxylate, 1,4-Cyclohexanedimethanol diglycidyl ether (which may be mixture of cis and trans), tris(2,3-epoxypropyl) isocyanurate, neopentyl glycol diglycidyl ether, bisphenol A diglycidyl ether, bisphenol A propoxylate diglycidyl ether, 3,4-epoxycyclohexylmethyl 3,4-epoxycyclohexanecarboxylate, poly[(o-cresyl glycidyl ether)-co-formaldehyde], poly(ethylene-co-glycidyl methacrylate), poly(ethylene-co-methyl acrylate-co-glycidyl methacrylate), poly(bisphenol A-co-epichlorohydrin) glycidyl end-capped, poly(ethylene glycol) diglycidyl ether, poly(propylene glycol) diglycidyl ether).

In some examples, the overcoat composition comprises a liquid carrier. The crosslinking agent may be suspended or dissolved in the liquid carrier. The liquid carrier, after applying the overcoat composition, may evaporate. The liquid carrier may be a carrier in which the crosslinking agent can dissolve, e.g. can dissolve completely, e.g. in an amount of 10 wt % or less or other amount stated herein. The liquid carrier may be a volatile organic solvent. The liquid carrier may, in the absence of the crosslinking agent, have a boiling point of 100° C. or less, in some examples a boiling point of 90° C. or less, in some examples a boiling point of 80° C. or less, in some examples a boiling point of from 50° C. to 90° C., in some examples a boiling point of from 50° C. to 80° C. Boiling points are those measured at standard pressure, i.e. 101325 Pa. The liquid carrier may have a dielectric constant of from 3 to 30, in some examples of from 3 to 20, in some examples of from 3 to 10, in some examples of from 5 to 8, as measured at 25° C. and 101325 Pa.

In some examples, the liquid carrier may be a polar aprotic solvent. The polar aprotic solvent may be selected from ethylacetate, tetrahydrofuran, dichloromethane, acetone, dimethylformamide, acetonitrile, and dimethylsulfoxide.

The overcoat composition may be applied so that it forms a coating, including any liquid carrier present, having a thickness of 100 μm or less, in some examples a coating of 80 μm or less, in some examples a coating of 50 μm or less, in some examples a coating of 30 μm or less, in some examples a coating of 20 μm or less. The overcoat composition may be applied so that it forms a coating, including any liquid carrier present, having a thickness of from 10 μm to 100 μm, in some examples a coating of from 10 μm to 50 μm, in some examples a coating of from 10 μm to 30 μm. If a liquid carrier is present, this may evaporate to produce an overcoat that is thinner than the values stated.

At the end of the method, and after any liquid carrier of the overcoat composition has been removed, the application of the overcoat composition may have increased the thickness of the print substrate by 10 μm or less, in some examples 5 μm or less, in some examples 2 μm or less, in some examples 1 μm or less, in some examples 0.5 μm or less, in some examples 0.2 μm or less, in some examples 0.1 μm or less, in some examples 0.08 μm or less, in some examples 0.05 μm or less.

The overcoat composition may be applied to the print substrate in any suitable manner, including spraying, jetting, painting, blade coating, air knife coating, rod coating, wire rod coating, roll coating, slot coating, slide hopper coating, gravure, curtain, and cascade coating.

In some examples, the crosslinking agent is present in an amount of less than 10 wt % in the overcoat composition, in some examples in an amount of 8 wt % or less in the overcoat composition, in some examples in an amount of 7 wt % or less in the overcoat composition, in some examples in an amount of 6 wt % or less in the overcoat composition, in some examples in an amount of 5 wt % or less in the overcoat composition, in some examples in an amount of 3 wt % or less in the overcoat composition, in some examples in an amount of 2 wt % or less in the overcoat composition, in some examples in an amount of 1 wt % or less in the overcoat composition; the remaining wt % may be liquid carrier as described herein.

In some examples, the crosslinking agent is present in an amount of from 0.1 to 10 wt % in the overcoat composition, in some examples in an amount of from 0.5 to 6 wt % in the overcoat composition, in some examples in an amount of from 0.5 to 4 wt % in the overcoat composition, in some examples in an amount of from 0.5 to 2 wt % in the overcoat composition, in some examples in an amount of from 0.5 to 1.5 wt % in the overcoat composition.

The method involves applying the overcoat composition comprising the crosslinking agent to the ink on the print substrate, such that the thermoplastic resin of the ink is crosslinked. In some examples, the crosslinking of the thermoplastic resin by the crosslinking agent is initiated and/or promoted by light (photoinitiation), such as ultraviolet light (UV photoinitiation); heat (thermal initiation); electron beam (e-beam initiation); ionising radiation, such as gamma radiation (gamma initiation); non-ionising radiation, such as microwave radiation (microwave initiation); or any combination thereof.

In some examples, the overcoat composition can be applied in the same printing apparatus that printed the ink on the print substrate. In some examples, the overcoat composition may be applied by a roller that contacts the print substrate, and the roller may form part of the same printing apparatus that printed the ink on the print substrate. In some examples, a single colour or impression (e.g. selected from magenta, cyan, yellow and black) is printed on the print substrate, and the overcoat composition applied to the ink, and the thermoplastic resin of the ink crosslinked, and then, in some examples, another colour or impression is printed on the same print substrate, and the overcoat composition applied to this other color of ink and the thermoplastic resin of this other colour of ink crosslinked. In some examples a plurality of colors of ink or separations of ink (e.g. selected from magenta, cyan, yellow and black) are printed onto the print substrate and the overcoat composition applied to the plurality of colors of ink, so that the thermoplastic resin of each different colored ink is crosslinked.

In some examples, the crosslinking is effected by heating the print substrate, for example to a temperature of 70° C. or more, in some examples 80° C. or more, in some examples 90° C. or more, in some examples 100° C. or more. In some examples, the crosslinking is effected by heating the print substrate, for example to a temperature of 70° C. to 200° C., in some examples 80° C. to 150° C., in some examples 90° C. to 120° C.

In some examples, the ink is or has been formed from an electrostatic ink composition. Before application to the print substrate in the electrostatic printing process, the ink may be an electrostatic ink composition, which may be in dry form, for example in the form of flowable particles comprising the thermoplastic resin. Alternatively, before application to the print substrate in the electrostatic printing process, the electrostatic ink composition may be in liquid form; and may comprises a carrier liquid in which is suspended particles of the thermoplastic resin. Generally, the carrier liquid can act as a dispersing medium for the other components in the electrostatic ink composition. For example, the carrier liquid can comprise or be a hydrocarbon, silicone oil, vegetable oil, etc. The carrier liquid can include, but is not limited to, an insulating, non-polar, non-aqueous liquid that can be used as a medium for toner particles. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In particular, the carrier liquids can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22 ™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid can constitute about 20% to 99.5% by weight of the electrostatic ink composition, in some examples 50% to 99.5% by weight of the electrostatic ink composition. Before printing, the carrier liquid may constitute about 40 to 90% by weight of the electrostatic ink composition. Before printing, the carrier liquid may constitute about 60% to 80% by weight of the electrostatic ink composition. Before printing, the carrier liquid may constitute about 90% to 99.5% by weight of the electrostatic ink composition, in some examples 95% to 99% by weight of the electrostatic ink composition.

The ink, when printed on the print substrate, and before the overcoat composition is applied, may be substantially free from carrier liquid. In an electrostatic printing process and/or afterwards, the carrier liquid may be removed, e.g. by an electrophoresis processes during printing and/or evaporation, such that substantially just solids are transferred to the print substrate. Substantially free from carrier liquid may indicate that the ink printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the ink printed on the print substrate is free from carrier liquid.

The ink and/or the ink printed on the print substrate can comprise a thermoplastic resin, which will for brevity be termed a 'resin' herein. A thermoplastic polymer is sometimes referred to as a thermoplastic resin. In some examples, the polymer may be selected from ethylene or propylene acrylic acid co-polymers; ethylene or propylene methacrylic acid co-polymers; ethylene vinyl acetate co-polymers; co-polymers of ethylene or propylene (e.g. 80 wt % to 99.9 wt %), and alkyl (e.g. C1 to C5) ester of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene ethylene ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may comprise a polymer having acidic side groups. Examples of the polymer having acidic side groups will now be described. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer, in some examples a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN 8 ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 or AC-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin in electrostatic ink or ink composition comprises a single type of polymer, the polymer (excluding any other components of the electrostatic ink composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic ink composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN 8 ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel 2022 and Bynel 2002, which are available from DuPont®.

The polymer having ester side groups may constitute 1% or more by weight of the total amount of the resin polymers, e.g. thermoplastic resin polymers, in the electrostatic ink composition and/or the ink printed on the print substrate, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the electrostatic ink composition and/or the ink printed on the print substrate. The polymer having ester side groups may constitute from 5% to 50% by weight of the total amount of the resin polymers, e.g. thermoplastic resin polymers, in the electrostatic ink composition and/or the ink printed on the print substrate, in some examples 10% to 40% by weight of the total amount of the resin polymers, e.g. thermoplastic resin polymers, in the electrostatic ink composition and/or the ink printed on the print substrate, in some examples 5% to 30% by weight of the total amount of the resin polymers, e.g. thermoplastic resin polymers, in the electrostatic ink composition and/or the ink printed on the print substrate, in some examples 5% to 15% by weight of the total amount of the resin polymers, e.g. thermoplastic resin polymers, in the electrostatic ink composition and/or the ink printed on the print substrate in some examples 15% to 30% by weight of the total amount of the resin polymers, e.g. thermoplastic resin polymers, in the electrostatic ink composition and/or the ink printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

In some examples, the ink applied to the print substrate is a liquid electrophotographic ink, comprising:

a carrier fluid;

a pigment;

a high melt viscosity ethylene acrylic acid copolymer resin; and a high acid ethylene acrylic acid copolymer resin having an acid content of at least 15 wt % and a viscosity of at least 8,000 poise;

wherein the liquid electrophotographic ink has a total resin acidity of at least 15 wt % and a total resin melt viscosity of at least 20,000 poise. The carrier fluid may be the carrier liquid described herein. In some examples, the ink applied to the print substrate is as described in WO/2012/105952.

The polymer, polymers, co-polymer or co-polymers of the resin can in some examples be selected from the Nucrel family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002, Bynell 2014, and Bynell 2020 (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

The resin can constitute about 5 to 90%, in some examples about 50 to 80%, by weight of the solids of the electrostatic ink composition and/or the ink printed on the print substrate. The resin can constitute about 60 to 95%, in some examples about 70 to 95%, by weight of the solids of the electrostatic ink composition and/or the ink printed on the print substrate.

The electrostatic ink composition and/or ink printed on the print substrate can comprise a charge director. A charge director can be added to an electrostatic ink composition to impart a charge of a desired polarity and/or maintain sufficient electrostatic charge on the particles of an electrostatic ink composition. The charge director may comprise ionic compounds, including, but not limited to, metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminium salts of sulfonic acid. The sulfonic acids may include, but are not limited to, alkyl sulfonic acids, aryl sulfonic acids, and sulfonic acids of alkyl succinates (e.g. see WO 2007/130069). The charge director can impart a negative charge or a positive charge on the resin-containing particles of an electrostatic ink composition.

The charge director can comprise a sulfosuccinate moiety of the general formula $[R_a—O—C(O)CH_2CH(SO_3^-)C(O)—O—R_b]$, where each of $R_a$ and $R_b$ is an alkyl group. In some examples, the charge director comprises nanoparticles of a simple salt and a sulfosuccinate salt of the general formula $MA_n$, wherein M is a metal, n is the valence of M, and A is an ion of the general formula $[R_a—O—C(O)CH_2CH(SO_3^-)C(O)—O—R_b]$, where each of $R_a$ and $R_b$ is an alkyl group, or other charge directors as found in WO2007130069, which is incorporation herein by reference in its entirety. As described in WO2007130069, the sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 200 nm or less, in some examples 2 nm or more. As described in WO2007130069, simple salts are salts that do not form micelles by themselves, although they may form a core for micelles with a micelle forming salt. The ions constructing the simple salts are all hydrophilic. The simple salt may comprise a cation selected from Mg, Ca, Ba, $NH_4$, tert-butyl ammonium, $Li^+$, and $Al^{+3}$, or from any sub-group thereof. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. The simple salt may be selected from $CaCO_3$, $Ba_2TiO_3$, $Al_2(SO_4)$, $A1(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. The charge director may further comprise basic barium petronate (BBP).

In the formula $[R_a—O—C(O)CH_2CH(SO_3^-)C(O)—O—R_b]$, in some examples, each of $R_a$ and $R_b$ is an aliphatic alkyl group. In some examples, each of $R_a$ and $R_b$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_a$ and $R_b$ are the same. In some examples, at least one of $R_a$ and $R_b$ is $C_{13}H_{27}$. In some examples, M is Na, K, Cs, Ca, or Ba. The formula $[R_a—O—C(O)CH_2CH(SO_3^-)C(O)—O—R_b]$ and/or the formula $MA_n$ may be as defined in any part of WO2007130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In an electrostatic ink composition, the charge director can constitute about 0.001% to 20%, in some examples 0.01 to 20% by weight, in some examples 0.01 to 10% by weight, in some examples 0.01 to 1% by weight of the solids of the electrostatic ink composition and/or ink printed on the print substrate. The charge director can constitute about 0.001 to 0.15% by weight of the solids of the electrostatic ink composition and/or ink printed on the print substrate, in some examples 0.001 to 0.15%, in some examples 0.001 to 0.02% by weight of the solids of the electrostatic ink composition and/or ink printed on the print substrate. In some examples, the charge director imparts a negative charge on the electrostatic ink composition. The particle conductivity may range from 50 to 500 pmho/cm, in some examples from 200-350 pmho/cm.

The electrostatic ink composition and/or ink printed on the print substrate can include a charge adjuvant. A charge adjuvant may be present with a charge director, and may be different to the charge director, and act to increase and/or stabilise the charge on particles, e.g. resin-containing particles, of an electrostatic ink composition. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the electrostatic ink composition and/or ink printed on the print substrate. The charge adjuvant can constitute about 0.5 to 4% by weight of the solids of the electrostatic ink composition and/or ink printed on the print substrate. The charge adjuvant can constitute about 1 to 3% by weight of the solids of the electrostatic ink composition and/or ink printed on the print substrate.

The electrostatic ink composition and/or ink printed on the print substrate may further comprise a colorant. The colorant may be selected from a pigment, dye and a combination thereof. The colorant may be transparent, unicolor or composed of any combination of available colors. The colorant may be selected from a cyan colorant, a yellow colorant, a magenta colorant and a black colorant. The electrostatic ink composition and/or ink printed on the print substrate may comprise a plurality of colorants. The electrostatic ink composition and/or ink printed on the print substrate may comprise a first colorant and second colorant, which are different from one another. Further colorants may also be present with the first and second colorants. The electrostatic ink composition and/or ink printed on the print substrate may comprise first and second colorants where each is independently selected from a cyan colorant, a yellow colorant, a magenta colorant and a black colorant. In some examples, the first colorant comprises a black colorant, and the second colorant comprises a non-black colorant, for example a colorant selected from a cyan colorant, a yellow colorant and a magenta colorant. The colorant may be selected from a phthalocyanine colorant, an indigold colorant, an indanthrone colorant, a monoazo colorant, a diazo colorant, inorganic salts and complexes, dioxazine colorant, perylene colorant, anthraquinone colorants, and any combination thereof.

The electrostatic or electrophotographic printing process may involve providing the ink in the form of an electrostatic ink composition comprising particles comprising the thermoplastic resin, the method comprising:

forming a latent electrostatic image on a surface;

contacting the surface with the electrostatic ink composition, such that at least some of the particles adhere to the surface to form a developed toner image on the surface, and transferring the toner image to the print substrate.

The surface on which the latent electrostatic image is formed may be on a rotating member, e.g. in the form of a cylinder. The surface on which the latent electrostatic image is formed may form part of a photo imaging plate (PIP). The contacting may involve passing the electrostatic ink composition between a stationary electrode and a rotating member, which may be a member having the surface having a latent electrostatic image thereon or a member in contact with the surface having a latent electrostatic image thereon. A voltage is applied between the stationary electrode and the rotating member, such that the particles adhere to the surface of the rotating member. This may involve subjecting the electrostatic ink composition to an electric field having a field gradient of 50-400V/μm, or more, in some examples 600-900V/μm, or more.

The intermediate transfer member may be a rotating flexible member, which is in some examples heated, e.g. to a temperature of from 80 to 160° C., in some examples from 90 to 130° C., in some examples from 100 to 110° C.

Also provided herein is a print substrate having printed thereon an ink comprising a thermoplastic resin comprising a polymer selected from ethylene or propylene acrylic acid co-polymers and ethylene or propylene methacrylic acid co-polymers, and having applied onto the ink a crosslinking agent, such that the thermoplastic resin of the ink is crosslinked; and the print substrate may be producible in or produced in a method as described herein.

The print substrate may be any suitable substrate. The substrate may be any suitable substrate capable of having an image printed thereon. The substrate may comprise a material selected from an organic or inorganic material. The material may comprise a natural polymeric material, e.g. cellulose. The material may comprise a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may comprise a metal, which may be in sheet form. The metal may be selected from or made from, for instance, aluminium (Al), silver (Ag), tin (Sn), copper (Cu), mixtures thereof. In an example, the substrate comprises a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print.

In an aspect, there is provided an electrostatic printing system comprising:

an electrostatic printer having loaded therein an electrostatic ink comprising a thermoplastic resin;

an overcoating device having loaded therein an overcoat composition comprising a crosslinking agent, wherein the system is configured to:

(a) apply the ink comprising a thermoplastic resin to a print substrate using an electrostatic printing process; and (b) apply an overcoat composition comprising a crosslinking agent to the ink on the print substrate, such that the thermoplastic resin of the ink is crosslinked.

The electrostatic printing system may be adapted to, e.g. programmed to, carry out the method described herein. All features described herein in relation to the method are equally applicable to the device.

The overcoating device may be a device for applying the overcoat composition to the print substrate in any suitable manner, including spraying, jetting, painting, blade coating, air knife coating, rod coating, wire rod coating, roll coating, slot coating, slide hopper coating, gravure, curtain, and cascade coating. The overcoating device may further comprise a device for initiating and/or promoting crosslinking, including, but not limited to, device that promotes crosslinking by emitting light (photoinitiation), such as ultraviolet light (UV photoinitiation); heat (thermal initiation); electron beam (e-beam initiation); ionising radiation, such as gamma radiation (gamma initiation); non-ionising radiation, such as microwave radiation (microwave initiation); or any combination thereof.

In some examples, the overcoating device forms part of the electrostatic printer. In some examples, the overcoating device comprises a roller, such that the overcoat composition may be applied by the roller that contacts the print substrate, and the roller may form part of the electrostatic printer. In some examples, the roller can be heated to effect the crosslinking, e.g. to a temperature of at least 80° C. In some examples, the electrostatic printing system is adapted so that the electrostatic printer can print a single colour or impression (e.g. selected from magenta, cyan, yellow and black) on the print substrate, and then the overcoating device apply the overcoat composition to the ink, such that the thermoplastic resin of the ink is crosslinked, and then, in some examples, the electrostatic printing device can print another colour or impression of ink on the same print substrate, and the overcoating device can apply the overcoat composition to this other color or impression of ink, such that the thermoplastic resin of this other colour or impression of ink crosslinked. In some examples, the electrostatic printing system is adapted so that the electrostatic printer prints a plurality of colors of ink or separations of ink (e.g. selected from magenta, cyan, yellow and black) onto the print substrate and the overcoating device then applies the overcoat composition to the plurality of colors of ink, so that the thermoplastic resin of each different colored ink is crosslinked.

EXAMPLES

The following illustrates examples of the methods and other aspects described herein. Thus, these Examples should not be considered as limitations of the present disclosure, but are merely in place to teach how to make examples of the present disclosure.

Materials

Trimethylpropane tris (2-methyl-1-aziridinepropionate) [XAMA2] was purchased from PolyAziridnes, LLC (MEDFORD, N.J., USA) and was used as received. 1,2,7,8-diepoxyoctane (DEOC), resorcinol diglycidyl ether (RDGE), trimethylolpropane triglycidyl ether (TMPTGE), N,N-Diglycidyl-4-glycidyloxyaniline (DGGOA), 4,4'-Methylenebis(N,N-diglycidylaniline) (MBDGA), tris(4-hydroxyphenyl)methane triglycidyl ether (THPMTGE), diglycidyl 1,2-cyclohexanedicarboxylate (DGCHDC), 1,4-Cyclohexanedimethanol diglycidyl ether, mixture of cis and trans (CHDMDGE), Tris(2,3-epoxypropyl) isocyanurate (TEPIC), neopentyl glycol diglycidyl ether (NPGDGE), bisphenol A diglycidyl ether (BPADGE), bisphenol A propoxylate diglycidyl ether (BAPDGE), and 3,4-Epoxycyclohexylmethyl 3,4-epoxycyclohexanecarboxylate (ECHECC) are all of analytical grade and were purchased from Sigma-Aldrich (Rehovot, Israel) and were used as received.

Poly[(phenyl glycidyl ether)-co-formaldehyde] [PPGE], poly(bisphenol A-co-epichlorohydrin), glycidyl end-capped [PBPADGE] (Mn-377 and 1,750), poly(ethylene-co-glycidyl methacrylate) [PEGM], poly(ethylene-co-methyl acrylate-co-glycidyl methacrylate) [PEMAGMA], poly[(o-cresyl glycidyl ether)-co-formaldehyde] [PCGE] (Mn=1,080), poly(dimethyl siloxane) diglycidyl ether terminated [PDMSDGE], poly(ethylene glycol) diglycidyl ether (PEGDGE, Mn=500), poly(propylene glycol) diglycidyl ether (PPGDGE, Mn=380 and 640) are all of analytical grade and were purchased from Sigma-Aldrich (Rehovot, Israel).

For chemical structures of the crosslinkers used, see Table I below.

Procedure for the Preparation of the Reactive Material Solution

The low-molecular weight reactive material (e.g. XAMA2, DEOC, RDGE, TMPTGE, MBDGA, DGGOA, MBDGA, DGCHDC, CHDMDGE, TEPIC, NPGDGE, BADGE, BAPDGE or ECHECC) was dissolved in ethyl acetate at 1 wt. %. The dissolution of the low-molecular weight reactive materials in ethyl acetate is instantaneous and can be used immediately after preparation.

The high-molecular weight reactive material (e.g. PPGE, PBPADGE, PEGM, PEMAGM, PCGE, PDMSDGE, PEGDGE, or PPGDGE) was dissolved in tetrahydrofuran (THF) at 1 wt %. The dissolution of the high-molecular weight reactive materials is very slow and mixing may be carried out over-night at room temperature.

Procedure for Varnishing the Reactive Material Solution on a Print Image

The image used for varnishing the solutions of the reactive materials was a 400% coverage scratch-resistance test (SRT), previously printed on a press (series 3) using either HP Electroink 4.5/NCD or E14.5/SCD inks. NCD indicates a charge director that, before addition to the ink, can comprise soya lecithin at 6.6% w/w, basic barium petronate BBP at 9.8% w/w, isopropyl amine dodecylebezene sulfonic acid at 3.6% w/w and about 80% w/w isoparaffin (IsoparaL from Exxon). SCD indicates a charge director that includes a sulfosuccinate moiety of the general formula [$R_a$—O—C(O)$CH_2$CH($SO_3^-$)C(O)—O—$R_b$], where each of $R_a$ and $R_b$ is an alkyl group. A blanket was placed on top of a draw-down plate which was preheated to 110° C. The blanket was allowed to stand for at least 10 minutes to reach the desired temperature (110° C. in this case). A white paper, normally coated EuroArt, attached directly on top of the blanket was used to protect the blanket from organic solvents (i.e. ethyl acetate and THF).

An SRT image, attached on top of the white paper on the preheated blanket of the drawdown, was allowed to stand for at least 10 seconds to reach an equilibrium temperature. Next, a ca. 2 cc of the diluted reactive material in the appropriate organic solvent was quickly applied as a stretch line on the upper edge of the image just below the rod coater. The application of the reactive materials, as well as the varnishing process, may be completed within 1-2 seconds to avoid fast evaporation of the solvent and thus precipitation of the reactive materials before being varnished. A 24 μm rod coater was applied in the process; however, 6-12 μm rods were as well good for low-viscosity solutions (i.e. solutions having low-molecular weights reactive materials). For high-molecular weight reactive materials solutions, which exhibit relatively high viscosity, a 24 μm rod was feasible. The solvent, i.e. ethyl acetate or THF, evaporates almost instantaneously after varnishing; however, the image was allowed to dry for an additional 10 seconds at 110° C. to guarantee the removal of solvent trace. Finally, the varnished images were dried at room temperature for at least 12 h before testing the scratch-resistance on the Taber-Shear instrument.

Results

Figure 2A:
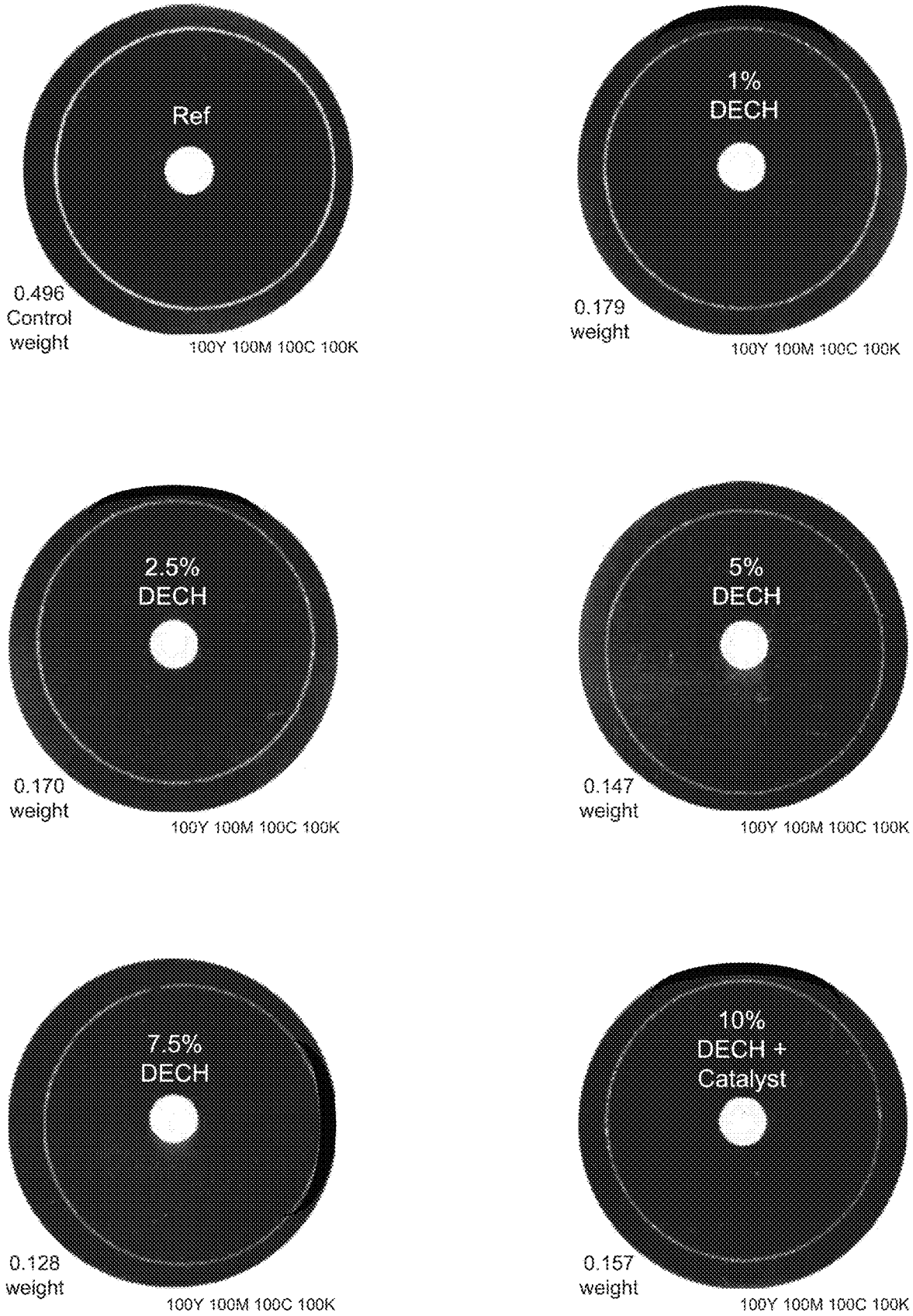
FIGS. 2A and 3A show further scratch resistant test results for various crosslinkers that may be used in embodiments of the method described herein.
Figure 2B:
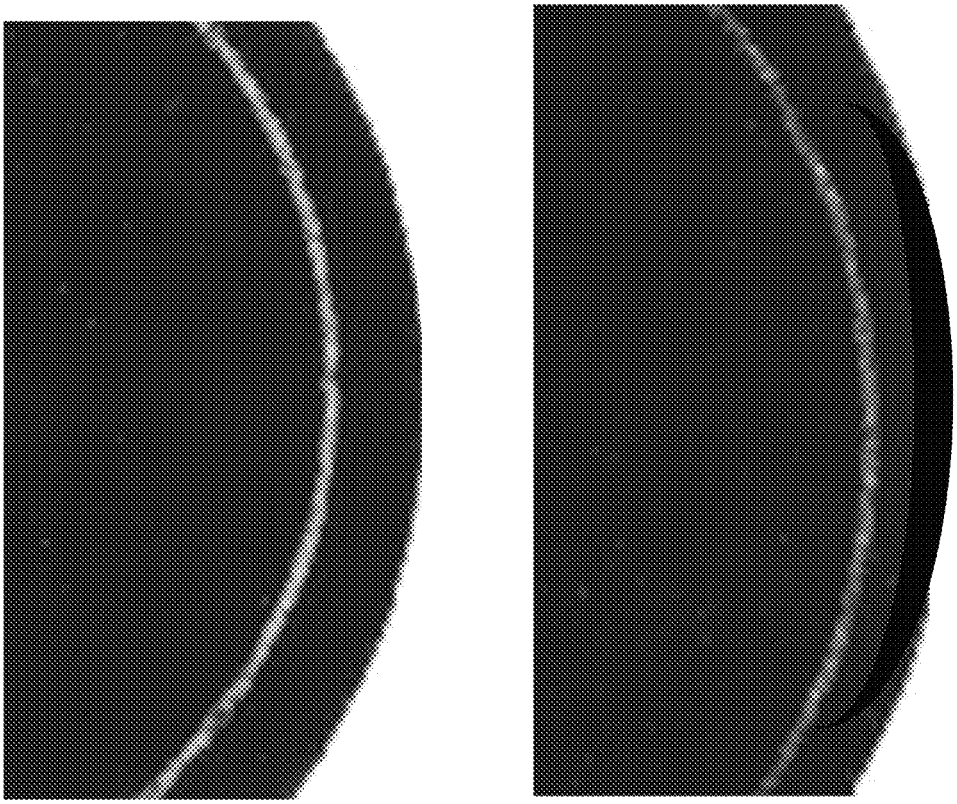
FIGS. 2B and 3B show test results for reference print substrates, i.e. without a crosslinker having been applied to the ink. These test results are described in more detail in the Examples below.
Figure 3A:
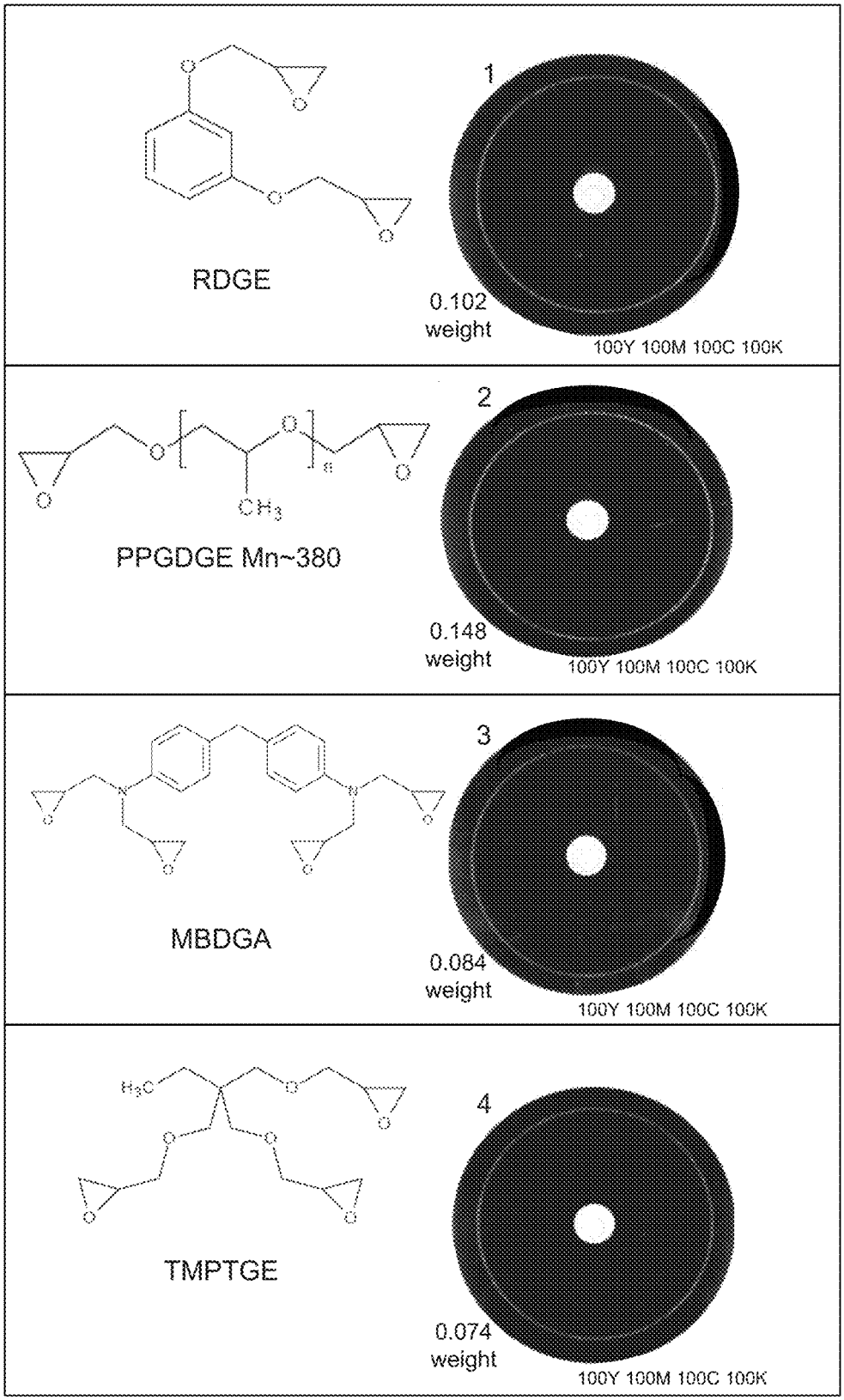
Figure 3B:
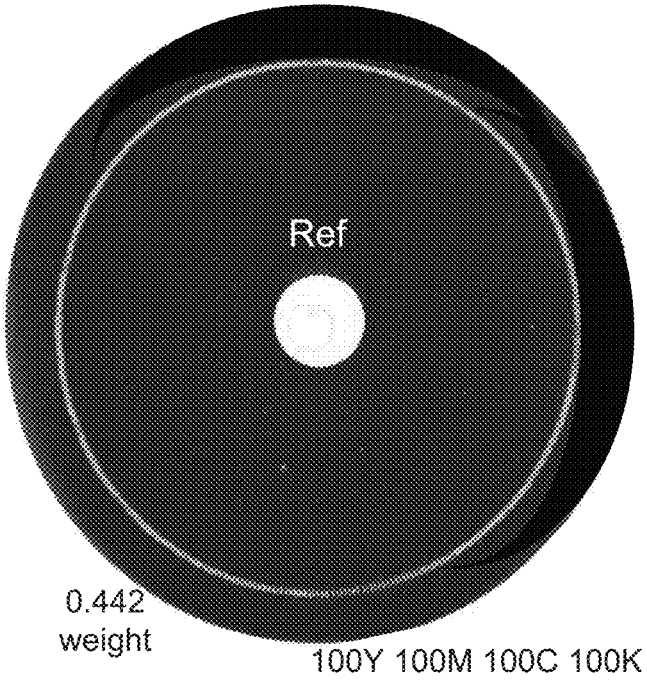

FIG. 1 summarizes the results obtained with varnishing XAMA2 on SRT images (400% K) using increasing XAMA2 concentrations (1%, 10% and 15%) in ethyl acetate. The best improvement in the scratch-resistance (SR) was obtained with 1% XAMA2. 10% and 15% XAMA2 resulted in brittle image which can be explained by over-crosslinking and thus converting the materials from a thermoplastic-like to a thermoset-like substance. Similarly, FIG. 2A shows the SRT images (YMCK) after varnishing with 3,4-epoxycyclohexylmethyl 3,4-epoxycyclohexanecarboxylate (ECHECC) at increasing concentration in ethyl acetate. FIG. 2B shows a comparison of SRT before and after varnishing with 1% ECHECC. FIG. 3A shows SRT after varnishing using other low-molecular weight reactive materials. FIG. 3B is a reference.

TABLE I

Chemical structures:
The crosslinker may be or comprise any of the following species.

| Chemical name | Abbreviation | Chemical structure |
|---|---|---|
| Trimethylpropane tris(2-methyl-1-azridinepropionate) | XAMA2 | 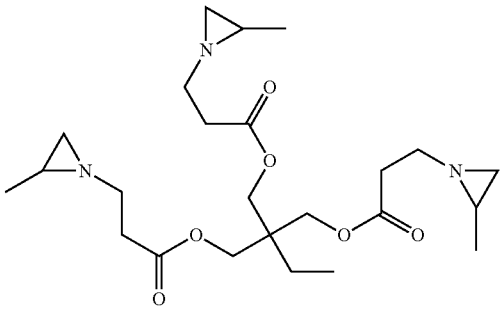 |

TABLE I-continued

Chemical structures:

The crosslinker may be or comprise any of the following species.

| Chemical name | Abbreviation | Chemical structure |
|---|---|---|
| 1,2,7,8-diepoxy octane | DEOC | 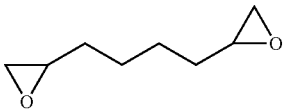 |
| trimethylolpropane triglycidyl ether | TMPTGE | 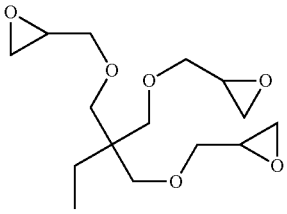 |
| resorcinol diglycidyl ether | RDGE | 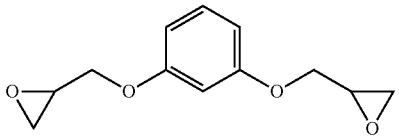 |
| N,N-Diglycidyl-4-glycidyl-oxyaniline | DGGOA | 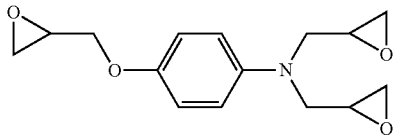 |
| 4,4'-Methylene-bis(N,N-diglycidylaniline) | MBDGA | 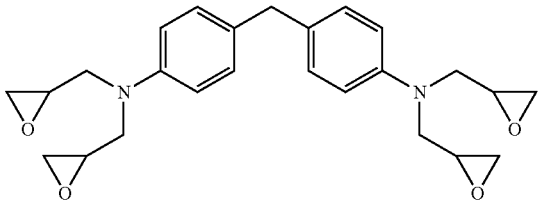 |
| Tris(4-hydroxyphenyl) methane triglycidyl ether | THPMTGE | 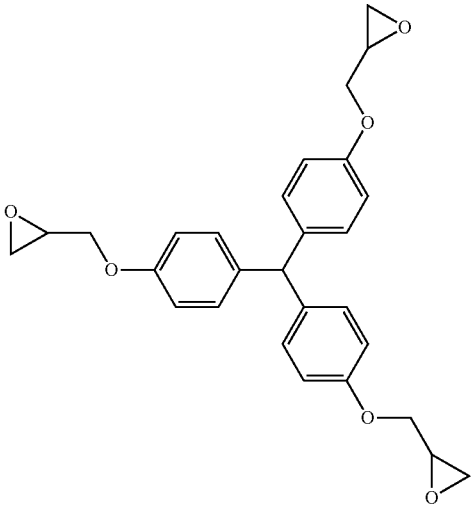 |

TABLE I-continued

Chemical structures:

The crosslinker may be or comprise any of the following species.

| Chemical name | Abbreviation | Chemical structure |
|---|---|---|
| diglycidyl 1,2-cyclohexane-dicarboxylate | DGCHDC | 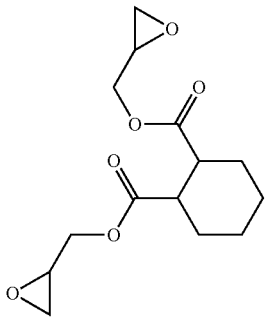 |
| 1,4-Cyclohexane-dimethanol diglycidyl ether, mixture of cis and trans | CHDMDGE | 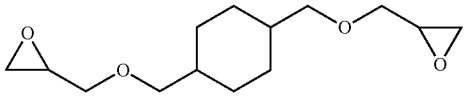 |
| Tris(2,3-epoxypropyl) isocyanurate | TEPIC | 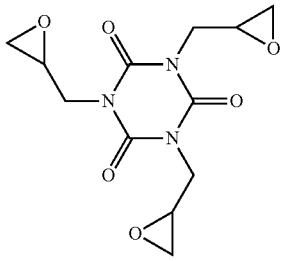 |
| Neopentyl glycol diglycidyl ether | NPGDGE | 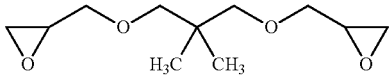 |
| Bisphenol A diglycidyl ether | BPADGE | 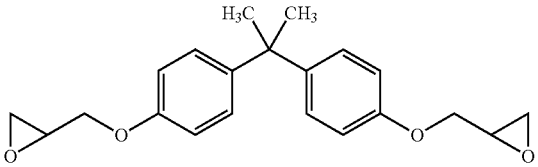 |
| bisphenol A propoxylate diglycidyl ether | BAPDGE | 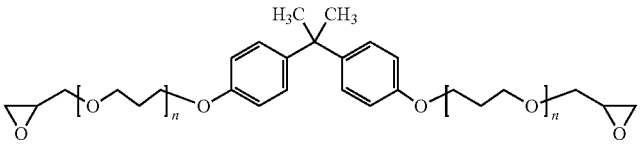 n ~ 1 |
| 3,4-Epoxycyclo-hexyl-methyl 3,4-epoxycyclo-hexane-carboxylate | ECHMECHC | 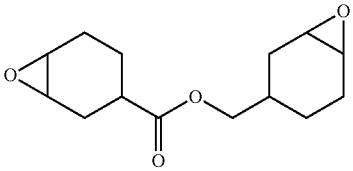 |

TABLE I-continued

| Chemical structures: The crosslinker may be or comprise any of the following species. | | |
|---|---|---|
| Chemical name | Abbreviation | Chemical structure |
| Poly(phenyl glycidyl ether)-co-formaldehyde | PPGE | 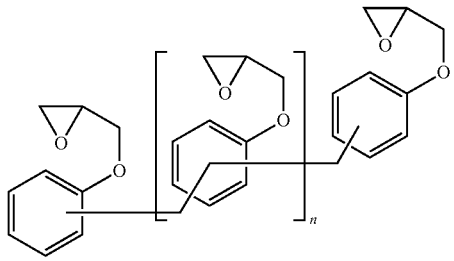 |
| poly[(o-cresyl glycidyl ether)-co-formaldehyde | PCGE | 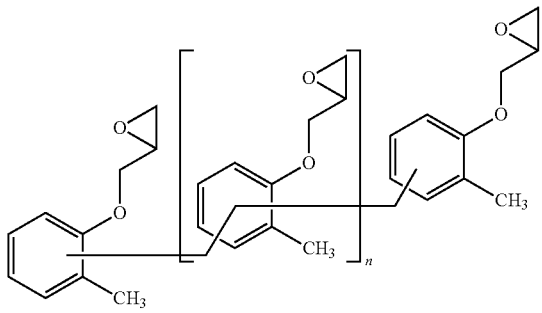 |
| Poly(ethylene-co-glycidyl methacrylate) | PEGM | 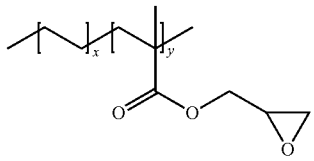 |
| Poly(ethylene-co-methyl acrylate-co-glycidyl methacrylate) | PEMAGM | 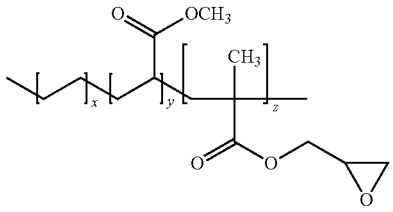 |
| poly(dimethyl siloxane) diglycidyl ether terminated | PDMSDGE | 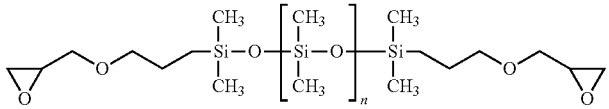 |
| poly(bisphenol A-co-epichlorohydrin) glycidyl end-capped | PBPADGE | 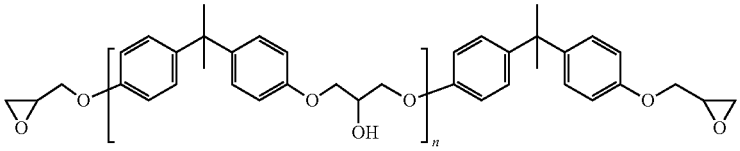 |
| poly(ethylene glycol) diglycidyl ether | PEGDGE | 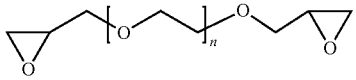 |
| polypropylene glycol) diglycidyl ether) | PPGDGE | 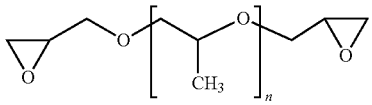 |

In the above formulae, 'n' represents an integer of 1 or more. 'n' can altered, depending, for example, on the desired molecular weight of the crosslinking agent.

While the methods, print substrates, printing systems and related aspects have been described with reference to certain examples, those skilled in the art will appreciate that various modifications, changes, omissions, and substitutions can be made without departing from the spirit of the disclosure. It is intended, therefore, that the methods, print substrates, printing systems and related aspects be limited by the scope of the following claims. The features of any dependent claim may be combined with the features of any of the independent claims or other dependent claims.

The invention claimed is:

1. A method of printing comprising the steps of:

(a) applying an ink comprising a thermoplastic resin including acidic side groups to a print substrate using an electrostatic printing process;

(b) applying an overcoat composition comprising a crosslinking agent to the ink after applying the ink to the print substrate, wherein the crosslinking agent is of formula (I), $$(X)—(Y—[Z—F]_m)_n \qquad \text{formula (I)}$$

wherein, in each $(Y—[Z—F]_m)_n$, Z and F are each independently selected such that F is selected from an aziridine group of the formula $N(CH_2CR^1H)$ or an epoxide of the formula $—CH(O)CR^2H$, wherein $R^1$ and $R^2$ are selected from H and alkyl; Z is alkylene; Y is selected from (i) a single bond, —O—, —C(=O)—O—, or —O—C(=O)— wherein m is 1 or (ii) Y is $—NH_{2-m}$, wherein m is 1 or 2; n is at least 1; and X is an organic group; and (c) initiating or promoting crosslinking of the thermoplastic resin of the ink due to an interaction with the crosslinking agent of the overcoat composition, wherein the initiating or the promoting includes photo initiation, thermal initiation, e-beam initiation, gamma initiation, non-ionizing radiation, or a combination thereof.

2. A method according to claim 1, wherein the crosslinking agent is or comprises a polyazridine or a polyepoxide.

3. A method according to claim 2, wherein the thermoplastic resin comprises a polymer selected from (i) ethylene or propylene acrylic acid co-polymers, or (ii) ethylene or propylene methacrylic acid co-polymers.

4. A method according to claim 1, wherein the crosslinking agent is present in an amount of less than 10 wt % in the overcoat composition.

5. A method according to claim 1, wherein the crosslinking agent is present in an amount of 6 wt % or less in the overcoat composition.

6. A method according to claim 1, wherein the crosslinking agent is present in an amount of from 0.5 to 2 wt % in the overcoat composition.

7. A method according to claim 1, wherein the crosslinking agent has a molecular weight of 5000 Daltons or less.

8. A method according to claim 1, wherein the crosslinking agent has a molecular weight of from 100 to 600 Daltons.

9. A method according to claim 1, wherein the crosslinking agent is selected from trimethylpropane tris(2-methyl-1-azridinepropionate), 1,2,7,8-diepoxy octane, trimethylolpropane triglycidyl ether, resorcinol diglycidyl ether, N,N-Diglycidyl-4-glycidyloxyaniline, 4,4'-Methylenebis(N,N-diglycidylaniline), tris(4-hydroxyphenyl)methane triglycidyl ether, diglycidyl 1,2-cyclohexanedicarboxylate, 1,4-Cyclohexanedimethanol diglycidyl ether, tris(2,3-epoxypropyl) isocyanurate, neopentyl glycol diglycidyl ether, bisphenol A diglycidyl ether, bisphenol A propoxylate diglycidyl ether, 3,4-epoxycyclohexylmethyl 3,4-epoxycyclohexanecarboxylate, poly[(o-cresyl glycidyl ether)-co-formaldehyde], poly(ethylene-co-glycidyl methacrylate), poly (ethylene-co-methyl acrylate-co-glycidyl methacrylate), poly(bisphenol A-co-epichlorohydrin) glycidyl end-capped, poly(ethylene glycol) diglycidyl ether, or poly(propylene glycol) diglycidyl ether).

* * * * *